United States Patent [19]

Scott

[11] 4,326,665

[45] Apr. 27, 1982

[54] GIFT PACKAGE SLEEVE

[75] Inventor: Raymond G. Scott, Oak Brook, Ill.

[73] Assignee: Champion International Corporation, Stamford, Conn.

[21] Appl. No.: 151,356

[22] Filed: May 19, 1980

[51] Int. Cl.[3] ..... B65D 75/02; B65D 75/54

[52] U.S. Cl. ..... 229/87 R; 229/40

[58] Field of Search ..... 229/87 R, 87 A, 87 B, 229/87 C, 87 J, 87 P, 40, 87 F, 87 G, 87 H

[56] References Cited

U.S. PATENT DOCUMENTS

| | | | |
|---|---|---|---|
| 2,619,226 | 11/1952 | Adams | 229/40 |
| 2,690,290 | 9/1954 | Turner | 229/40 |
| 2,996,236 | 8/1961 | Barr | 229/87 F |
| 3,106,288 | 10/1963 | Balding | 229/40 |
| 3,116,154 | 12/1963 | Rumsey | 229/87 F |
| 3,224,630 | 12/1965 | Spery | 229/40 |

FOREIGN PATENT DOCUMENTS

| | | | |
|---|---|---|---|
| 147245 | 7/1952 | Australia | 229/40 |
| 36674 | 5/1906 | Switzerland | 229/40 |

*Primary Examiner*—Herbert F. Ross
*Attorney, Agent, or Firm*—Evelyn M. Sommer

[57] ABSTRACT

A sleeve slides over an erected and closed carton to maintain it in its closed position. The sleeve may be of paper or paperboard and includes an integral flap covering an underlying sleeve area. The flap and underlying area are preferably printed or decorated to form a greeting or gift card.

4 Claims, 5 Drawing Figures

GIFT PACKAGE SLEEVE

BACKGROUND OF THE INVENTION

The present invention relates to packaging and more particularly to a paper or paperboard gift package sleeve which fits over an erected and closed carton. The subject matter of this invention is related to the subject matter of commonly assigned co-pending application Ser. No. 148,265, filed May 9, 1980, to Robert C. Zdarsky.

At the present time various types of gift wrappings are used to decorate cartons. For example, if a customer purchases a small item such as a sweater, a carton may be erected by the salesperson and the sweater placed in the erected carton. If the item is to be used by the purchaser, frequently the carton is closed by tabs on the carton or by placing a string or elastic band around the carton. However, if the item is to be presented as a gift, the customer often desires a more elaborate and decorative wrapping. In one type of gift wrapping a sheet of decorated paper may be torn from a roll of paper and folded about the erected carton. The wrapped paper may be held in position by one-sided gummed tape or by string or an elastic band.

This type of gift wrapping, although it results in a gift box having a pleasing appearance, is relatively costly, both in terms of the time of the salesperson and in the cost of the wrapping material. For these reaons sometimes stores will request their customers to take the unwrapped items to a special gift wrapping section during busy times of the year, for example, at the Christmas season, or may charge an extra amount for gift wrapping. In addition, stores may be reluctant to gift-wrap items when the salespeople are busy or when the items are relatively low in cost.

An alternative to a separate paper gift wrapping is a decorated sleeve which is slipped over the erected carton. The sleeve generally is a tubular paper or paperboard member which is maintained in a flat condition until it is ready to be used by the salesperson. The salesperson, as in conventional gift wrapping, will place the purchased item in an erected carton and close the carton. Then the sleeve will be slipped over the erected and closed carton to maintain the carton in its closed position. The sleeve may be decorated with printed matter, for example, the store name or season's greetings, and may be printed with a decoration which matches or complements the color or decoration on the carton. This type of sleeve may be placed on the carton as rapidly as other types of carton closing devices such as strings or elastic bands. Such sleeves are relatively low in cost compared to decorated paper wrappings.

SUMMARY OF THE INVENTION

In accordance with the present invention a tubular sleeve is provided which is adapted to be slid over an erected and closed carton. The sleeve may be of paper or paperboard so that it is relatively low in cost, and may be maintained in a flat position until it is ready to be used by the salesperson. The sleeve, in addition, includes a flap which covers an underlying area. The flap, together with the underlying area, constitutes a greeting card. The greeting card may be printed with suitable indicia; for example, it may display a Christmas greeting or a birthday greeting. The card may contain an area on the flap or on the underlying area so that the individual may sign the card or express his own written greeting.

It is an object of the present invention to provide a sleeve for wrapping an erected and closed carton, which sleeve includes a greeting card.

It is a further objective of the present invention to provide such a sleeve which may be made of paper or paperboard utilizing conventional manufacturing techniques, so that the sleeve may be relatively low in cost compared to the wrapping paper used for gift wrapping.

It is a further objective of the present invention to provide such a sleeve which will be comparable to gift wrapping paper in appearance and customer acceptance and yet comparable in cost to plain sleeves used for the closure of cartons.

BRIEF DESCRIPTION OF THE DRAWINGS

Other objectives of the present invention will be apparent from the following detailed description of the preferred embodiment of the present invention. The following detailed description should be taken in conjunction with the accompanying drawings.

In the drawings.

DETAILED DESCRIPTION OF THE INVENTION

Figure 1:
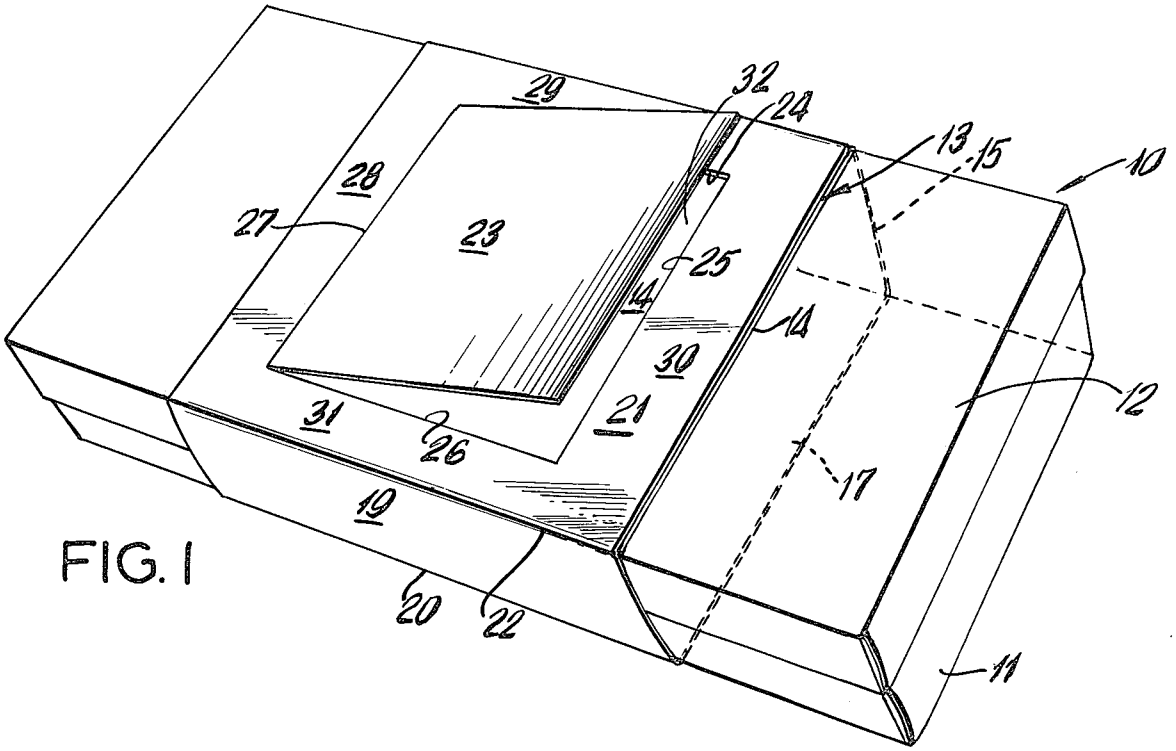
FIG. 1 is a perspective view of the sleeve of the present invention after it has been positioned on an erected carton.

As shown in FIG. 1, when a salesperson sells an item to the customer, he would erect a carton 10, place the item in the erected carton, and close the carton. The carton 10 may be of conventional construction having a bottom tray portion 11 and a covering portion 12. The salesperson will then slip the sleeve 13 of the present invention over the carton 10 to maintain the carton in its closed position.

Figure 2:
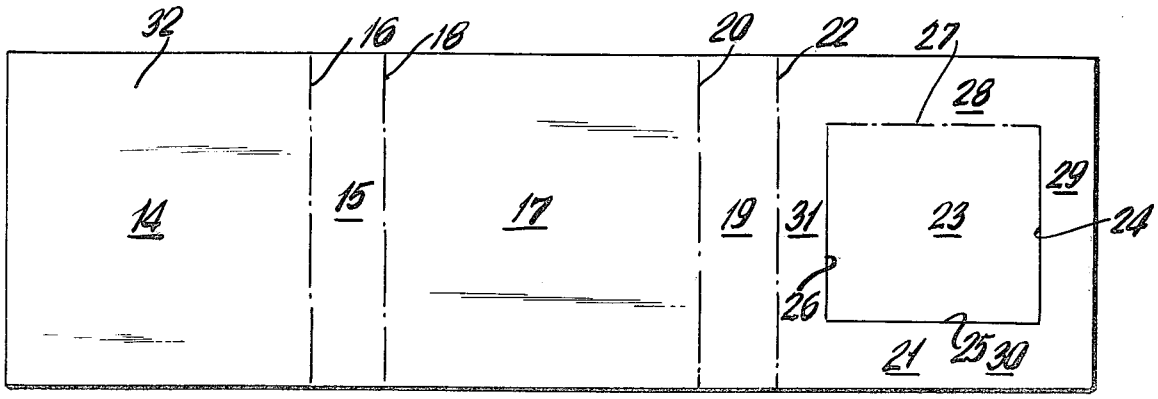
FIG. 2 is a top plan view of the blank utilized in constructing the sleeve shown in FIG. 1.

The sleeve 13 is made from the blank illustrated in FIG. 2. The blank may be die-cut from paper or paperboard using conventional manufacturing techniques and machinery. The blank includes an underlying rectangular panel 14 and a first rectangular side panel 15 connected to the panel 14 by the fold line 16. A bottom rectangular panel 17 is connected to the first side panel by the fold line 18 and is of the same size and shape as the underlying panel 14. A second side panel 19 is connected to the bottom panel 17 by the fold line 20.

A top panel 21, which is rectangular and is the same external size and shape as the underlying panel 14, is connected to the second side panel 19 by the fold line 22. The top panel 21 includes a flap 23 which is formed by die-cutting three lines 24, 25 and 26. The die-cut line 25 is at right angles to the opposed die-cut lines 24 and 26. The flap 23 is rectangular and its fourth side, opposite to the die-cut line 25, is formed by the fold line 27. The fold line 27 may be a score line so that the flap 23 may be easily folded back.

The sleeve 13 is formed into its tubular shape by adhering the underside of the panel 21, at selected glue-line locations, to the top side of the panel 14. The selected areas of the glue lines are at the outer edges 28, 29, 30 and 31, which outer edges are external to the cut lines 24–26 and the fold line 27.

The tubular sleeve 13, after it has been glued together, may be shipped in a flat state with the fold lines 20 and 16 folded so that the panels lie flat against each other and with the internal face of the panel 14 touching the internal face of the panel 17. Alternatively, the sleeves may be supplied, joined by score lines, on a roll.

When the salesperson is ready to use the sleeve, he opens the sleeve and erects it by placing the first and second side panels, respectively 15 and 19, at right angles to the bottom and top panel, respectively 17 and 21. He then slips the erected sleeve over the erected and closed carton.

The customer may lift the flap 23 and write a greeting on the underlying area 32 (part of panel 14). Preferably the face of the top panel 21 and the external face of the flap 23 are decorated with a suitable decoration, for example, with a printed message; for example, it may be printed as a Christmas card. Similarly, the underlying area 32 may have a suitable decoration, such as the greetings for a Christmas or a holiday card, or the message may be printed to resemble a book with its cover open. Additional pages of a card may be formed by gluing the glue flaps of several cards along the line 27, so that they appear as several pages of the book.

Figure 3:
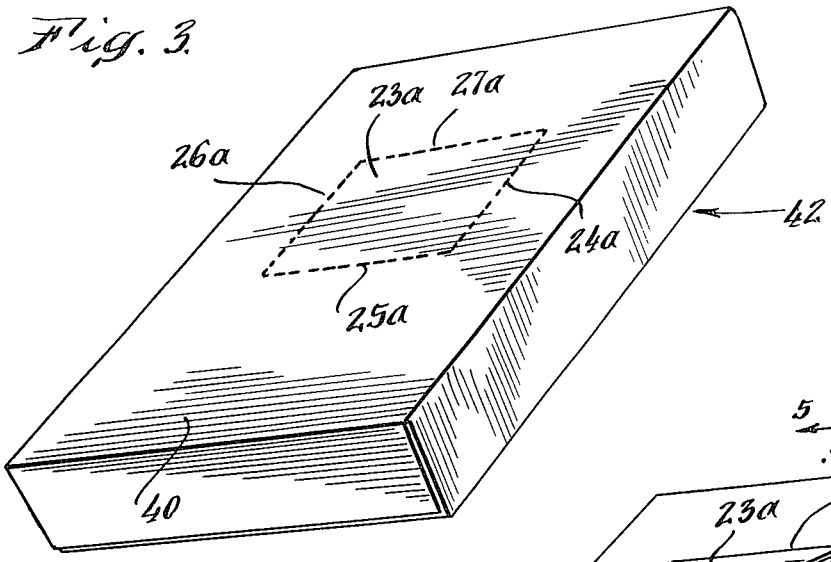
FIG. 3 is a perspective view of an alternative embodiment of the invention wherein the greeting card portion of the sleeve can be formed directly on the carton itself.
Figure 4:
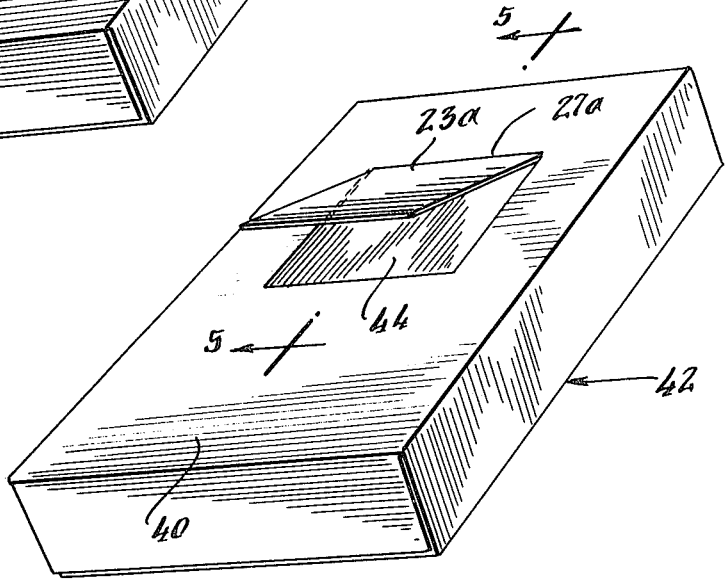
FIG. 4 is a view similar to FIG. 3, but with the card portion of the carton opened.
Figure 5:
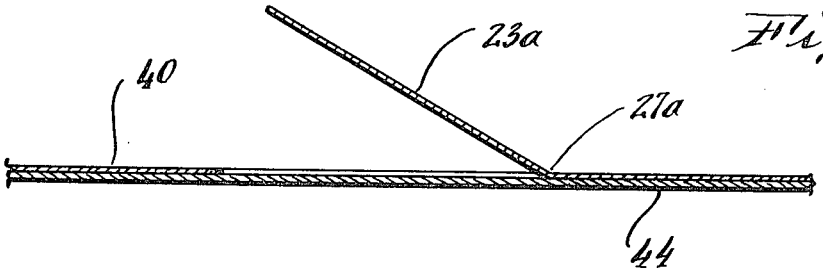
FIG. 5 is a cross-sectional view taken substantially along the plane indicated by line 5—5 of FIG. 4.

As shown in FIGS. 3 to 5, in lieu of a conventional carton 10 overwrapped with sleeve 13, the flap 23*a* corresponding to flap 23 on sleeve 13 may be formed directly on a side panel 40 of a one-piece carton 42 (or directly on the cover element of a two-piece carton in order to conserve material), as long as the carton 42 includes a second panel 44 beneath panel 40.

The top side panel 40 includes the flap 23*a* which is formed by die-cutting three lines 24*a*, 25*a*, and 26*a*. The die-cut line 25*a* is at right angles to the opposed die-cut lines 24*a* and 26*a*. The flap 23*a* is rectangular and its fourth side, opposite to the die-cut line 25*a* is formed by the fold line 27*a*. The fold line 27*a* may be a score line so that the flap 23*a* may be easily folded back.

What is claimed is:

1. A container having an integral greeting card thereon, said container comprising:

(a) a bottom panel;

(b) a pair of side panels connected to said bottom panel along opposed parallel fold lines;

(c) an underlying panel connected to one of said side panels along a fold line parallel to said opposed parallel fold lines;

(d) a top panel connected to the other of said side panels along a fold line parallel to said opposed parallel fold lines, said top panel overlying said underlying panel;

(e) means forming a hinged flap integrally in an internal portion of said top panel, said flap overlying a mid portion of said underlying panel; and (f) adhesive means securing said top panel to said underlying panel, said adhesive means being restricted to peripheral portions of said top and underlying panels, and said mid portion of said underlying panel and said flap being free of said adhesive means, and said mid portion of said underlying panel and said flap combining to form said integral greeting card on said container in which said flap can be folded back from said mid portion of said underlying panel to expose said mid portion of said underlying panel to view a message written thereon.

2. The container of claim 1 further comprising printed material disposed on said mid portion of said underlying panel.

3. The container of claim 1, wherein said bottom, top and underlying panels are each approximately equal in size.

4. The container of claim 1, wherein said container is an open-ended sleeve adapted to be telescoped over a box so as to provide a decorative wrapper for the box.

* * * * *